United States Patent [19]

Cottell

[11] 4,400,177

[45] Aug. 23, 1983

[54] FUELS AND METHODS FOR THEIR PRODUCTION

[76] Inventor: Eric C. Cottell, Windermere, Bayville, Long Island, N.Y. 11709

[21] Appl. No.: 342,055

[22] Filed: Jan. 25, 1982

Related U.S. Application Data

[63] Continuation-in-part of Ser. No. 83,506, Sep. 24, 1979, abandoned.

[51] Int. Cl.[3] ..... C10L 1/32

[52] U.S. Cl. ..... 44/51

[58] Field of Search ..... 44/51

[56] References Cited

U.S. PATENT DOCUMENTS 1,390,232 2/1922 Bates ..... 44/51

*Primary Examiner*—Jacqueline V. Howard

[57] ABSTRACT

A stable fuel emulsion comprising water, coal and an oil component comprising a distillate oil and a residual oil stabilizing ingredient. The stable fuel is produced by forming a water/coal slurry, blending the distillate oil and stabilizing residual oil together, combining the slurry and oil blend and agitating the mixture.

Further, a stable fuel emulsion comprising essentially only water and oil wherein the oil is comprised of a distillate oil component and a residual oil stabilizing ingredient. The stable fuel is produced by blending the distillate oil and the stabilizing residual oil together, combining the resulting blend with water and agitating the mixture.

12 Claims, No Drawings

FUELS AND METHODS FOR THEIR PRODUCTION

CROSS REFERENCE TO RELATED APPLICATION

This application is a continuation-in-part of Application Ser. No. 083,506, filed on Sept. 24, 1979, now abandoned.

BACKGROUND OF THE INVENTION

The present invention is related to fuel emulsions. In one embodiment, the present invention provides a stable fuel emulsion of water/coal and oil, and in another embodiment a stable fuel emulsion of essentially only water and oil. The present invention further provides methods for producing each of these stabilized fuel emulsions.

A water/coal and oil fuel is described in my U.S. Pat. No. 3,941,552, issued on Mar. 2, 1976, as well as is a system for rendering the emulsion stable. A water/oil fuel is described in my U.S. Pat. No. 3,749,318 issued on July 31, 1973. In each of these patents, and as is generally recognized, there is a need for the fuel to be rendered stable, i.e., to stabilize the emulsion so that it may be transported, stored and burned efficiently. The usual technique to achieve this end is to add to the components of the emulsion one or more surfactants such as described, for example, in U.S. Pat. No. 3,210,168 issued Oct. 5, 1965 to Arnold J. Morway. The problem is that these surfactants are relatively expensive and detract from, rather than add to the calorific value of the fuels. The present invention provides fuel emulsions which are stable and which do not include surfactants.

SUMMARY OF THE INVENTION

The present invention provides a stable fuel emulsion of coal, water, a distillate oil component and a residual oil stabilizing component, and a method for producing the same.

The present invention also provides a stable fuel emulsion of water, a distillate oil component and a residual oil stabilizing component, and a method for producing the same.

More particularly, the present invention provides a stable fuel emulsion comprising greater than 3 weight percent water, coal, distillate oil and a stabilizing ingredient selected from the group consisting of No. 4 residual oil, No. 6 residual oil, other residual oils and combinations thereof.

The present invention also provides a method of producing a stable fuel emulsion of coal, oil and water comprising the steps of forming a slurry of water and coal, the water being greater than 3 weight percent of the slurry, blending a stabilizing ingredient consisting of a residual oil component selected from the group consisting of No. 4 residual oil, No. 6 residual oil, other residual oils and combinations thereof with a distillate oil component, the residual oil component being between about 1% and about 30% by weight of the distillate oil component, combining the slurry of coal and water with the blended oil components, and subjecting the resulting coal/oil/water mixture to agitation to form the stable fuel emulsion.

The present invention further provides a stable fuel emulsion comprising essentially only distillate oil, water and a stabilizing ingredient selected from the group consisting of No. 4 residual oil, No. 6 residual oil, other residual oils and combinations thereof.

The present invention still further provides a method of producing a stable fuel emulsion consisting essentially only oil and water, the method comprising the steps of blending a stabilizing ingredient consisting of a residual oil component selected from the group consisting of No. 4 residual oil, No. 6 residual oil, other residual oils and combinations thereof with a distillate oil component to form a blend of these oils, combining the resulting blend of oils with water, and agitating the water/oil combination to form the stable fuel emulsion.

DESCRIPTION OF THE PREFERRED EMBODIMENTS

The present invention in one embodiment provides a stable fuel emulsion of water, coal and oil. The water component consists of an amount of water from about 3 weight percent up to and including about 20 weight percent of the emulsion, the coal component consists of up to and including about 50 weight percent of the emulsion, and the oil component consists of up to about at total of 30 weight percent of the emulsion.

A distillate oil will readily combine with water into an oil-water system, but will not readily combine with water into a water-oil system. A residual oil, on the other hand, will naturally combine with water into a water-oil system. The reasons for this contrary phenomena are not precisely known, however, it is suspected that the impurities in the residual oil, such as for example resins, which have been refined out of the distillate oil, is the cause. For this reason, the oil component of the emulsion in turn comprises two components; a distillate oil component and a stabilizing ingredient. The distillate oil component is, for example, a No. 2 distillate oil, and the stabilizing ingredient is selected from the group consisting of No. 4 residual oil, No. 6 residual oil, other residual oils and combinations thereof. The stabilizing ingredient comprises between about 1% and about 30% by weight of the distillate oil component. In practice, it has been determined that a stabilizing ingredient of less than about 10% by weight of the distillate oil component works well.

The stable water, oil and coal fuel is produced by forming a slurry of water and coal. Preferably, the water comprises greater than 3 weight percent of the slurry, and can range up to about 20 weight percent. The coal is preferably of about 200 mesh in size. In one advantageous method, the distillate oil is added to the slurry to cause spherical agglomeration, and then the stabilizing residual oil ingredient is added to produce a water-oil system. The stabilizing ingredient comprises between about 1% and about 30% by weight of the distillate oil component. Next, the coal/water/oil mixture is agitated to form a stable fuel emulsion. Alternatively, the distillate oil component and stabilizing ingredients are blended together separately from the coal/water slurry. As mentioned above, the stabilizing ingredient comprises between about 1% and about 30% by weight of the distillate oil component. A higher percent of distillate oil than stabilizing residual oil is advantageous for the reason that the distillate oil will promote flocculation and spherical agglomeration. Next, the coal/water slurry is combined with the blended oil components to provide a water-oil system mixture, and this resulting coal/oil/water mixture is agitated to form the stable fuel emulsion. The agitation should be sufficient to cause cavitation within the mixture.

The slurrying of the water and coal, and the blending of distillate oil and stabilizing ingredient can be carried out in virtually any type of convenient vessel or system. Although the agitation of the resulting coal/oil/water mixture can be accomplished by a number of means, it has been determined that in a continuing flow process an ultrasonic reactor operating at an energy density sufficient to cause cavitation within the resulting coal-/oil/water mixture works well of the short residence time of the resulting mixture in the agitator, as opposed to a batch process wherein the residence time in the agitator can be extended.

The present invention, in another preferred embodiment, provides a somewhat different stable fuel emulsion than discussed above. Unlike the stable fuel emulsion discussed above, this fuel emulsion does not include any coal. This second stable fuel emulsion consists essentially only of distillate oil, water and a stabilizing ingredient. In this stable oil/water emulsion, the water comprises up to about 15 weight percent of the emulsion, the distillate oil comprises about 80% by weight of the emulsion and the stabilizing ingredient comprises about 5% by weight of the emulsion.

As with the stable fuel emulsion of coal/oil and water the stabilizing ingredient of the stable oil/water emulsion is selected from the group consisting of No. 4 residual oil, No. 6 residual oil, other residual oils and combinations thereof, and the distillate oil is, for example, No. 2 distillate oil. The stabilizing ingredient comprises between about 1% and about 30% by weight of the distillate oil component.

For the reasons mentioned above concerning the natural propensity of distillate oil to combine with water into an oil-water system, and for residual oil to combine with water into a water-oil system, the stable fuel emulsion of water, distillate oil and a stabilizing ingredient is produced by first blending the stabilizing ingredient with the distillate oil component to form a resulting blend of oils, then combining the resulting blend of oils with the water. This water/oil combination is agitated to form the stable fuel emulsion. The agitation should be sufficient to cause cavitation within the mixture.

The blending of the stabilizing ingredient and distillate oil component, and the combining of the resulting blend thereof with the water can be carried out in virtually any type of convenient vessel or system. Although the agitation of the water/oil combination can be accomplished by a number of means, it has been determined that an ultrasonic reactor operating at an energy density sufficient to cause cavitation within the water-/oil combination works well, particularly in a continuing process, as opposed to a batch process, for producing the stable fuel.

As can be readily seen from the above detailed discussion, the present invention provides a stable water, oil and coal fuel emulsion which is stable without the addition of surfactants, and in which the oil and water have combined into a water-oil system. The present invention further provides a stable fuel emulsion of essentially only water and oil without the addition of surfacts and in which the water and oil have combined into a water-oil system.

The foregoing detailed description is given primarily for clearness of understanding and no unnecessary limitations should be understood therefrom for modifications will become obvious to those skilled in the art upon reading this disclosure and may be made without departing from the spirit of the invention and scope of the appended claims.

I claim:

1. A stable fuel emulsion comprising coal, distillate oil, greater than 3 weight percent water, and a stabilizing ingredient selected from the group consisting of No. 4 residual oil, No. 6 residual oil, other residual oils and combinations thereof.

2. The stable fuel emulsion of claim 1 wherein said stabilizing ingredient comprises between about 1% and about 30% by weight of said distillate oil.

3. The stable fuel emulsion of claim 1, wherein said water comprises about 20 weight percent.

4. The stable fuel emulsion of claim 1 wherein:

said water comprises about 20 weight percent of the emulsion;

said coal comprises about 50 weight percent of the emulsion;

said distillate oil component comprises about 25 weight percent of the emulsion; and, said stabilizing ingredient comprises about 5 weight percent of the emulsion.

5. A method of producing a stable fuel emulsion of coal, oil and water, the method comprising the steps of:

forming a slurry of water and coal, the water being greater than 3 weight percent of the slurry;

blending a stabilizing ingredient consisting of a residual oil component selected from the group consisting of No. 4 residual oil, No. 6 residual oil, other residual oils and combinations thereof with a distillate oil component, the residual oil component being between about 1% and about 30% by weight of the distillate oil component;

combining the slurry of coal and water with the blended oil components; and, subjecting the resulting coal/oil/water mixture to agitation to form said stable fuel emulsion.

6. The method of claim 5 wherein the agitation of the resulting coal/oil/water mixture is sufficient to cause cavitation thereof.

7. A stable fuel emulsion comprising essentially only distillate oil, water, and a stabilizing ingredient selected from the group consisting of No. 4 residual oil, No. 6 residual oil, other residual oils and combinations thereof.

8. The stable fuel emulsion of claim 7, wherein said water comprises less than 15 weight percent of the emulsion.

9. The stable fuel emulsion of claim 7, wherein said stabilizing ingredient component comprises between about 1% and about 30% by weight of said distillate oil component.

10. The stable fuel emulsion of claim 7, wherein said distillate oil is No. 2 distillate oil.

11. A method of producing a stable fuel emulsion consisting essentially only of oil and water, the method comprising the steps of:

blending a stabilizing ingredient consisting of a residual oil component selected from the group consisting of No. 4 residual oil, No. 6 residual oil, other residual oils and combinations thereof with a distillate oil component to form a blend of these oils;

combining the resulting blend of oils with water; and, agitating the water/oil combination to form the stable fuel emulsion.

12. The method of claim 11, wherein the agitation of the water/oil combination is sufficient to cause cavitation.

* * * * *